US005308922A

United States Patent [19]

Wallace et al.

[11] Patent Number: 5,308,922

[45] Date of Patent: May 3, 1994

[54] WIRE CONNECTOR AND METHOD OF MANUFACTURE

[75] Inventors: John S. Wallace, Birmingham; Mark C. Thurber, Rochester Hills, both of Mich.

[73] Assignee: Reactive Industries, Inc., Troy, Mich.

[21] Appl. No.: 894,909

[22] Filed: Jun. 8, 1992

[51] Int. Cl.[5] ..... H01R 4/22

[52] U.S. Cl. ..... 174/87; 206/219; 403/214; 403/265; 403/268; 403/396; 411/258

[58] Field of Search ..... 174/87; 206/219, 221, 206/222; 403/214, 396, 265, 268, 270; 411/258

[56] References Cited

U.S. PATENT DOCUMENTS

| | | | |
|---|---|---|---|
| Re. 28,812 | 5/1976 | Duffy | 10/10 P |
| 2,772,323 | 11/1956 | Smith | 174/87 |
| 2,825,750 | 3/1958 | Stockwell | 174/87 |
| 3,083,260 | 3/1963 | Bird | 174/87 |
| 3,087,606 | 4/1963 | Bollmeier et al. | 206/219 |
| 3,243,211 | 3/1966 | Wetmore . | |
| 3,360,631 | 12/1967 | Hess . | |
| 3,550,765 | 12/1970 | Anderson | 174/87 |
| 3,558,800 | 1/1971 | Wallis | 174/87 |
| 3,642,937 | 2/1972 | Deckert et al. . | |
| 3,704,264 | 11/1972 | Gorman . | |
| 3,721,749 | 3/1973 | Glabburn | 174/88 R |
| 3,746,068 | 7/1973 | Deckert et al. . | |
| 3,783,177 | 1/1974 | Kelso | 174/87 |
| 3,787,222 | 1/1974 | Duffy . | |
| 3,852,517 | 12/1974 | Del Fava | 174/84 R |
| 3,930,606 | 1/1976 | Dewdney | 174/DIG. 8 |
| 3,944,721 | 3/1976 | Reeder | 174/88 R |
| 3,945,114 | 3/1976 | Siden et al. | 174/112 |
| 4,059,136 | 11/1977 | Wallace | 411/258 |
| 4,070,398 | 1/1978 | Lu | 156/272 X |
| 4,081,012 | 3/1978 | Wallace | 411/258 |
| 4,091,122 | 5/1978 | Davis et al. | 427/44 |
| 4,228,216 | 10/1980 | Austin et al. | 428/307 |
| 4,285,378 | 8/1981 | Wallace | 411/258 |
| 4,325,985 | 4/1982 | Wallace | 427/54.1 |
| 4,366,190 | 12/1982 | Rodden et al. | 427/183 |
| 4,428,982 | 1/1984 | Wallace | 411/258 |
| 4,484,204 | 11/1984 | Yamamoto et al. | 346/200 |
| 4,536,524 | 8/1985 | Hart et al. | 156/330 X |
| 4,545,712 | 10/1985 | Wallace | 411/258 |
| 4,553,809 | 11/1985 | Holt | 174/84 R |
| 4,588,639 | 5/1986 | Ozono | 428/402.22 |
| 4,632,944 | 12/1986 | Thompson | 522/11 |
| 4,686,272 | 8/1987 | Wallace | 528/87 |
| 4,764,579 | 8/1988 | Wallace | 528/87 |
| 4,778,948 | 10/1988 | Fitch et al. | 174/88 R |
| 4,847,113 | 7/1989 | Wallace | 427/54.1 |
| 5,000,636 | 3/1991 | Wallace | 411/258 |
| 5,023,402 | 6/1991 | King, Jr. et al. | 174/87 |
| 5,113,037 | 5/1992 | King, Jr. et al. | 174/87 |

*Primary Examiner*—Morris H. Nimmo
*Attorney, Agent, or Firm*—Thomas P. Liniak

[57] ABSTRACT

A fastening system comprises a housing having a closed end and an open end. A first mixable fastener component is disposed within the housing at the closed end and defines a first volume, the first volume being substantially devoid of gas. A rupturable skin overlie the first component proximate the open end for maintaining the first component within the housing.

24 Claims, 2 Drawing Sheets

WIRE CONNECTOR AND METHOD OF MANUFACTURE

FIELD OF THE INVENTION

The disclosed invention relates to an improved wire connector which utilizes a two-component epoxy adhesive for adhesively securing wires to the wire connector and for sealing the secured wires. Substantially all of the air is evacuated from the wire connector prior to introduction of the epoxy resin in order to minimize the adverse effects created by air bubbles and moisture.

BACKGROUND OF THE INVENTION

Mechanical fastening systems employing two fastener elements, such as a nut and bolt, can become loosened due to vibration, temperature changes and the like, with the result that the connection may fail or not be satisfactory for the intended purpose. It is known to provide an epoxy adhesive system on at least one of the fastener elements, in order to adhesively secure the connected elements and thereby prevent unintended loosening. Mechanical fasteners are normally manufactured by someone other than the ultimate user, and it is desired that the adhesive system be applied by the manufacturer so that complications for the ultimate user are minimized. The epoxy adhesive components are normally applied in an uncured condition, and interconnection of the elements, such as by threading the nut onto the bolt, has the effect of mixing the resin components and thereby permitting them to react and cure.

Various means have been disclosed for permitting the adhesive components to be applied to the mechanical fastening elements in the uncured condition. It is known, for example, to apply in spaced relation both components of an epoxy resin system to a single one of the elements of the mechanical fastening system. Means are provided to maintain the epoxy system components separated so that unintended or accidental mixing and resultant curing is prevented. It is known, for example, to provide each of the components of the epoxy system with a photocurable additive which forms a frangible skin. The skin has sufficient structural integrity to withstand the stresses which may arise during shipment and handling, but yet will be readily ruptured and thereby allow the components to be mixed and ultimately cured when the fastener elements are combined.

Formation of the rupturable skin by the addition of a radiation curable film forming material is known, and the film forming agent may be the same for both components of a two-part epoxy resin system comprising a resin and a hardener. A photoinitiator is also customarily provided in order to enhance formation of the skin upon exposure to ultraviolet radiation.

A wire connector is a well-known means for securing together the ends of wires. A wire connector typically comprises a plastic or like insulating housing which is open at one end. A coil spring of somewhat hourglass shape is typically provided in the cavity of the housing and has the purpose of grasping the usually twisted together ends of the wires in order to draw them into the wire connector. A wire connector, like the other mechanical fasteners earlier discussed, may permit the wires to become loosened from within the wire connector, thereby permitting them to be pulled apart or to be exposed. Exposure of the wires may cause damage to the user or otherwise, and is to be avoided. For this reason, it is well-known to wrap the wire connector and a portion of the wires with an insulating adhesive tape, normally of a coated cloth or plastic composition, so that the wire connector will remain secured to the wires. Application of electrical tape is, however, a time consuming, expensive, and unreliable process.

Co-pending U.S. application Ser. No. 655,854, filed Feb. 15, 1991 by Mark Thurber and Richard M. Wallace for Adhesive systems, the disclosure of which is incorporated herein by reference, is directed to certain improvements in adhesively secured mechanical fasteners, including wire connector. That application discloses a two-component epoxy resin adhesive having an improved film-forming material for creating the frangible skin. Use of the epoxy resin adhesive with a wire connector is also disclosed.

We have found that the use of two-component epoxy resin adhesives in wire connector fasteners does have various advantages over the previous use of electrical tape. Because of the frustoconical shape of a wire connector, however, certain new problems have arisen which may adversely affect the use of the wire connector, its manufacture, and its shipability. We have discovered, for example, that filling the wire connector with the epoxy resin causes an air pocket to be formed within and/or about the spring. As discussed in the referenced application, the resin is separated from the hardener by a rupturable skin, and we have found that the relatively weak bond between the rupturable skin and the wire connector may be broken by the air pocket as it migrates within the chamber of the wire connector. It is not unusual for wire connector to be shipped by airplane, with the result that the air pocket may become relatively more mobile on account of the reduced atmospheric pressure around the connector, thereby being able to more readily separate the rupturable skin from the wire connector and permit the hardener and resin to mix and begin to cure. Once the integrity of the bond between the skin and the wire connector has been broken, then curing will begin, and the wire connector may eventually be unusable.

Yet a further problem which we have discovered concerns the deterioration in the cure speed which may occur in the event the hardener is exposed to moisture coming from the air pocket. Relatively moist air, such as may occur during the warm, humid summer months, will be dispersed within the hardener as it fills the wire connector, with the result that the cure of the resin by the hardener may take longer than desired. The rupturable skin overlying the hardener prevents it from being exposed to the ambient air, but the entrainment of moist air during the filling process still allows water to be introduced into the hardener.

Those skilled in the art will understand that a commercially acceptable adhesively securable wire connector must be able to be shipped from a remote manufacturer to the ultimate user without concern that the epoxy resin adhesive components will interact and cure during shipment, handling, and storage. The disclosed invention relates to a wire connector assembly and its method of manufacture which avoids the noted problems by filling the wire connector with the epoxy resin in an environment which is substantially devoid of air and water vapor. Substantially all of the air is evacuated from the wire connector by means of a vacuum applied prior to filling with the epoxy resin, thereby substantially eliminating the air pocket which may lift the skin and permit the introduction of moisture into the hardener.

OBJECTS AND SUMMARY OF INVENTION

A primary object of the disclosed invention is a wire connector which is filled with the epoxy resin while the wire connector is substantially devoid of air.

Another object of the invention is a method for manufacturing a wire connector which includes evacuating substantially all of the air from the wire connector prior to filling the wire connector with the epoxy resin.

A fastening system according to the invention comprises a housing having a closed end and an open end. A first mixable fastener component is disposed within the housing at the closed end and defines a first volume, the first volume being substantially devoid of a gas. First rupturable means overlie the first component proximate the open end for maintaining the first component within the housing.

A wire connector, according to the invention, comprises a basket having a chamber with an open end and an opposite closed end. A coil is disposed within the chamber and extends from the closed end to a point intermediate the open end. A mixable adhesive composition is disposed within the chamber and encapsulates the coil, the composition and that portion of the chamber which is filled by the composition being substantially devoid of air. The composition has an overlying rupturable skin which maintains the composition within the chamber.

A wire connector assembly comprises a basket having a chamber with an open end and an opposite closed end. A helical coil spring is secured to the closed end and extends therefrom toward and terminates short of the open end. An epoxy resin is disposed within the chamber and fills the chamber by an amount sufficient to overlie the spring, the resin having a rupturable skin for maintaining the system within the chamber. A hardener is disposed within the chamber and overlies the skin, the hardener having a rupturable skin for maintaining the hardener within the chamber. The hardener is reactive with the resin for forming an adhesive adapted for securing an article positioned within the chamber and engaged with the spring. The resin and the portion of the chamber filled thereby are substantially devoid of air.

A method for manufacturing a fastener assembly comprises the steps of providing a fastener housing having a chamber with an open end and a closed end. Substantially all of the atmosphere is evacuated from the chamber. At least a portion of the chamber is filled with an adhesive system, and the system is secured within the chamber.

A wire connector manufacturing process comprises the steps of providing a wire connector basket having a chamber with an open end and a closed end, with a coil spring disposed within the chamber and extending from the closed end toward the open end and terminating short thereof. A vacuum is applied to the chamber for evacuating substantially all of the atmosphere therefrom. A quantity of a first adhesive system is supplied to the chamber in an amount sufficient to overlie the spring. The first adhesive system is secured within the chamber. A quantity of a second adhesive system is supplied to the chamber and overlies the first system. The first and second systems are reactive for bonding an article inserted into the chamber. The second adhesive system is secured within the chamber.

These and other objects and advantages of the invention will be readily apparent in view of the following detailed description of the drawings of the above described invention.

DESCRIPTION OF THE DRAWINGS

The above and other objects and advantages and novel features of the present invention will become apparent from the following detailed description of the preferred embodiment of the invention illustrated in the accompanying drawings wherein.

DETAILED DESCRIPTION OF THE INVENTION

Figure 1:
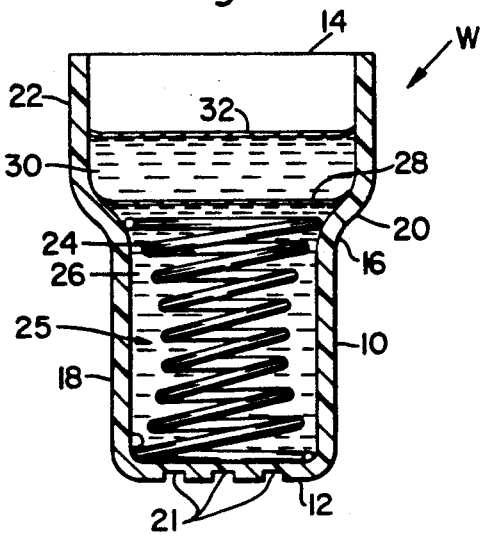
FIG. 1 is a cross sectional view of a wire connector according to the invention.

Wire connector W of FIG. 1 includes a frustoconical insulating basket 10 which has a closed end 12 and an open end 14. The basket 10, which may be of plastic, rubber or like material, has a knee 16 between straight section 18 and outwardly angularly disposed section 20. A further straight section 22 extends from the angled section 20 and leads to open end 14. The basket 10 therefore has an interior chamber which is accessible through open end 14. Ribs 21 are disposed about lower end 12 of basket 10.

Helical coil spring 24 has an hourglass shape with a first end secured to closed end 12 and an opposite end terminating in the region of angled section 20. The cylinder formed by straight section 18 thereby forms an open space 25 with the spring 24. The spring 24 may be secured to closed end 12 by any one of a number of means known in the art. The spring 24 may be formed of suitable material, such as copper, brass or the like. Wire connectors having the configuration of basket 10 and a spring 24 are known in the art, and those skilled in the art may select one having the size, shape and characteristics suitable for securing the intended wires.

The earlier application discloses a two-component epoxy resin system used in a wire connector assembly for adhesively bonding the wires within the basket. In the present invention, a quantity of a first component 26 fills the basket 10 by an amount sufficient to encapsulate the wire 24, preferably to the region from which the second straight section 22 joins the angled section 20. We prefer that the first component 26 be the resin component, and that a rupturable skin 28 be formed on the exposed surface of the component 26 in order to maintain that first component 26 within the basket 10. A second component 30, which preferably is the hardener component, is then supplied to the basket 10 in overlying relation to the skin 28. As with the resin component 26, a rupturable skin 32 is formed on the exposed surface of the hardener 30 for maintaining the hardener within the basket 10. The hardener 30 is supplied in a quantity sufficient to react with the resin 26, preferable at a ratio of about 3:1, in order to provide a cured adhesive capable of bonding an inserted wire to the spring 24. The ultraviolet light for forming the skins 28 and 32 is introduced through open end 14. The skins 28 and 32 are rupturable so that insertion of a wire through open end 14 will cause the skins 28 and 32 to break, and thereby permit the resin 26 to mix with the hardener 30 in order to form an adhesive for bonding the wire within basket 10.

Figure 2:
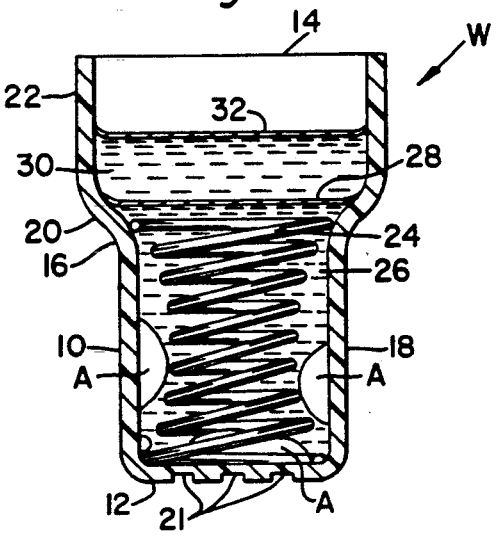
FIG. 2 is a cross sectional view of a wire connector filled without use of the air evacuation of the invention.

The wire connector W of FIG. 2 is of conventional design, as is the wire connector of FIG. 1, but it has been filled without evacuating the air first. As a result, air pockets A are formed about and within spring 24 in the course of the filling operation. While we have illustrated in FIG. 2 the air pockets as being discrete items, they may comprise a unitary pocket about spring 24.

As noted, we have found that the introduction of the resin 26 into the basket 10 causes an air pocket to be created within the region defined by the spring 24. For this reason, we apply to the basket 10 a vacuum of sufficient intensity to evacuate substantially all of the air or atmosphere from the basket 10 prior to the resin 26 being introduced. A vacuum of about 27 in. of mercury, which is about a 90% vacuum, is sufficient we have found. Evacuation of the air from the basket 10 precludes the formation of the air pocket. Once a sufficient quantity of resin 26 has been supplied to the basket 10, then an ultraviolet lamp of sufficient intensity and wavelength is directed at the surface of the resin 26 through open end 14 in order to form the skin 28. The resin 26 should fill the basket 10 by an amount sufficient to cover spring 24, thereby permitting the skin 28 to remain intact and preclude hardener 30 from migrating along the interface of spring 24 and skin 28.

After the skin 28 has been formed, then the hardener 30 is supplied in an amount sufficient to react with the resin 26. Again, an ultraviolet lamp of sufficient intensity and appropriate wavelength is directed at the exposed surface of the hardener 30, thereby creating the skin 32.

We prefer that the resin component 26 be formulated to contain between 15–74% by weight of an epoxy resin, 20–75% by weight of a UV-polymerizable monomer, and 1–10% by weight of a UV activated photoinitiator.

A suitable example of a commercially available epoxy resin is bisphenol A epichlorohydrin resin, and the most preferred such resin is an epoxy bisphenol A epichlorohydrin resin obtained by reacting bisphenol A and epicholorohydrin. The preferred resin may be obtained commercially from Shell Chemical under the name EPON 828. This resin is an uncrosslinked, short-chain prepolymer, rather than a monomer.

Typical UV-polymerizable monomers used in the resin component 26 include chemical compounds classified as acrylic esters, methacrylic esters, vinyl esters, vinyl ethers, acrylic ethers, allyl esters, allyl ethers, epoxides, styrene and substituted styrenes, vinyl pyrrolidone, acrylamide and substituted acrylamides, acrylonitrile, and dienes. Although trimethylopropane triacrylate may be used in the monomer of resin component 26, one may also use ethoxylated bisphenol A dimethacrylate (EBAD) and 1, 6-hexanediol dimethacrylate (HDDMA). Aromatic acrylated urethanes can be used in place of or in combination with the listed monomers.

The UV activated photoinitiators may include ketones, benzophenones, aromatic ketones, Mychler's ketones, benzoin ethers, alkyl aryl ketones, benzil ketals, oximer esters, halogenated tioxanthones, onium salts, fluoborates, peroxides, azo free radical generators, and promoters like tertiary amine accelerators, organometallic complexes and mixtures of the above.

The hardener component 30 is, preferably, approximately 75–85% by weight hardener, 14–24% by weight UV-polymerizable monomer, and 1–10% photoinitiator. The most preferred formulation for the hardener component 30 contains 80% hardener compound, of which 90–97% is the hardener XU-195, sold by Ciba-Geigy and 3–10% of which is the booster BDMA. The hardener is a Lewis acid type catalyst, and we prefer a boron-trifluoride complex type hardener. The remaining 20% of the formulation is preferably composed of EBAD (97%) and the photoinitiator (3%).

Figure 3:
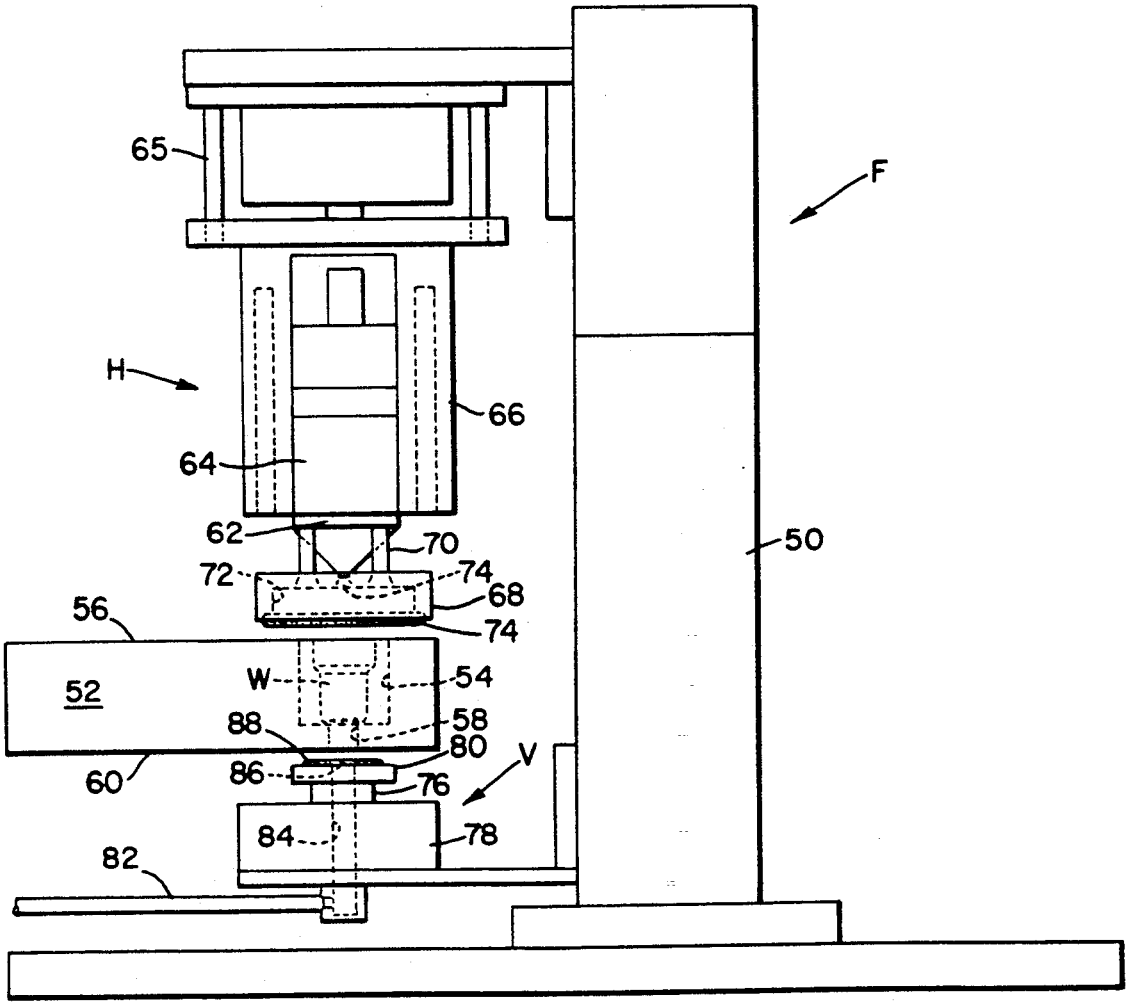
FIG. 3 is a schematic view of the air evacuation and resin filling system of the invention in a first orientation.
Figure 4:
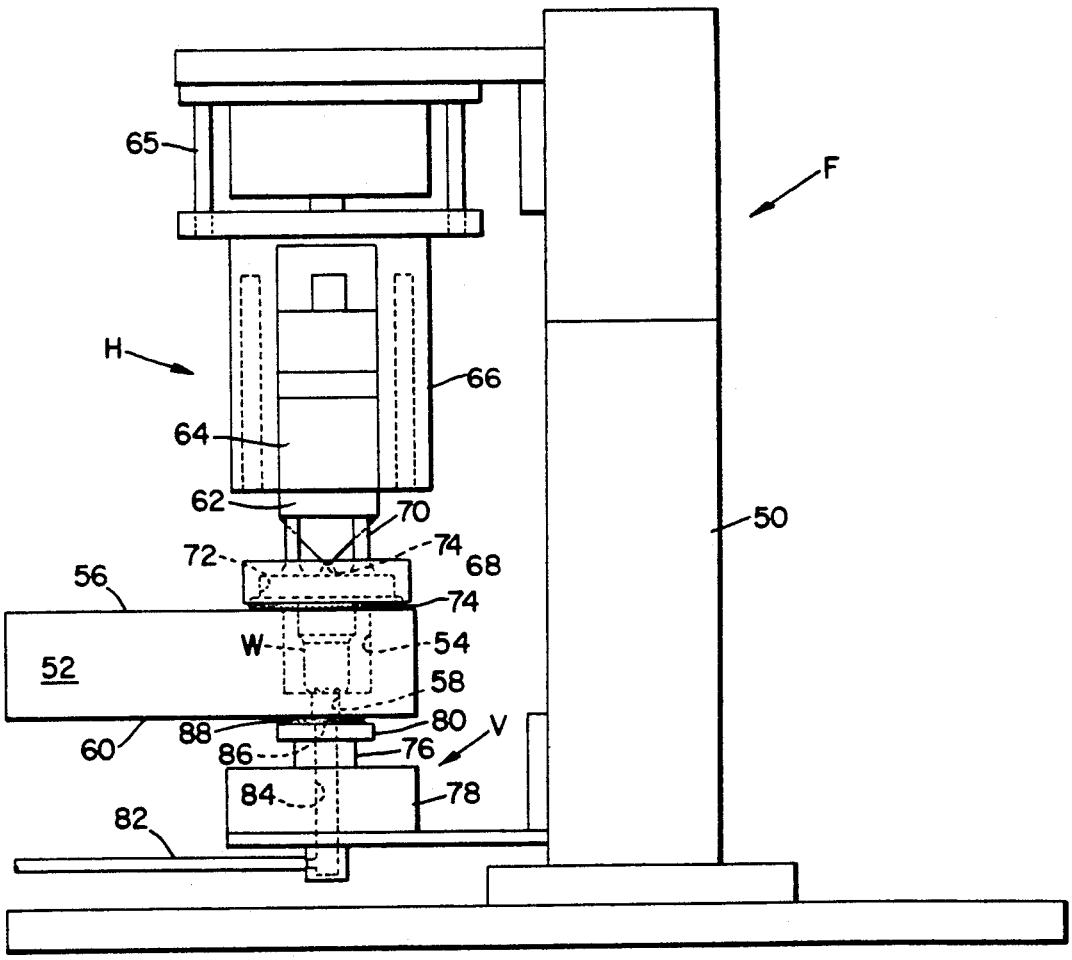
FIG. 4 is a schematic view of the system of FIG. 3 in a second orientation.

FIGS. 3 and 4 illustrate the machine F which is used for evacuating the air from the wire connectors W and filling them with the adhesive components. The hardener 30 is deposited with a conventional squirt-type filling gun and is downstream of filling head H.

Filling machine F of FIGS. 3 and 4 has a pedestal 50 and a rotary table 52 adjacent thereto. Table 52 has an opening 54 therein for receiving wire connector W. The circular table 52 preferable is sufficiently large to have a plurality of radially spaced openings 54 into which wire connectors W may be placed. Opening 54 opens on top surface 56 of table 52 and has a communicating cylindrical opening 58 leading to lower surface 60.

Filling head H is suspended from pedestal 50 and overlies surface 56. Piston 62 is reciprocally associated with cylinder 64 for displacing filling box 68 relative to surface 56. Fasteners 70 secure filling box 68 to piston 62. The driving system for piston 62 is preferably attached to pedestal 50 by support 65.

Filling box 68 has an internal chamber 72 which spans the breadth of opening 54 at surface 56. Elastomeric O-ring 74 extends about chamber 72 and is selectively sealingly engageable with surface 56. Fine needle 74 of a conventional hot melt gun is positioned within chamber 72 for supplying the fluidic resin component 26 to the wire connector W. Those skilled in the art will understand that the pumping mechanism for suppling resin to needle 74 is conventional and that hoses lead from the needle 74 to the pump.

Vacuum assembly V is adjacent pedestal 50 and is disposed below surface 52, as best shown in FIG. 3. Piston 76 of cylinder 78 carries head 80. Vacuum line 82 communicates with opening 84 within cylinder 78. Opening 84 extends through head 80, so that a vacuum applied to line 82 by assembly V is ultimately applied to aperture 86 of head 80. Elastomeric O-ring 88 extends about aperture 86 and is adapted to be selectively sealingly engaged with surface 60 and about opening 58.

Filling machine F is shown in the filling orientation in FIG. 4. As shown therein, filling box 68 has been placed onto surface 56 by extension of piston 62. The O-ring 74 forms an essentially airtight seal about opening 54 on surface 56. Piston 76 extends simultaneously with piston 62, thereby causing head 80 to engage surface 60. Opening 88 forms an airtight seal about opening 58.

Once the pistons 62 and 76 have been extended, then a vacuum is applied to vacuum line 82 in order to evacuate the atmosphere from within the filling chamber defined by chamber 72 and openings 54 and 58. As earlier noted, the vacuum should be about 27 in. of mercury, in order to evacuate substantially all of the atmosphere therefrom and from within the wire connector W. The wire connector W typically has a plurality of ribs 21 extending from its lower end. The ribs 21 prevent the opening 58 from being blocked by the lower end of the wire connector W when the vacuum is applied.

After box 68 and head 80 have been properly positioned against their respective surfaces of table 52, then resin component 26 is squirted from needle 74 into wire connector W. We prefer that there be three parts of resin to one part hardener, and filling takes approximately one second.

Upon wire connector W being filled with the resin 26, then the pistons 62 and 76 retract after the vacuum in the sealed chamber has been removed. The table 52 then indexes so that the next opening 54 containing a wire connector W is below filling box 68. Indexing continues until each filled wire connector W is positioned below the ultraviolet source. We allow a number of indexations to occur before the filled wire connector W is below the infrared source in order to allow the resin 26 to settle. After the skin 28 has been formed, then we again allow several indexations to occur before the hardener 30 is applied. This allows the resin 26 to cool, because some heat is generated by the ultraviolet burst. After the hardener 30 has been deposited, then the skin 32 is formed by application of ultraviolet radiation. The cooled wire connector W may then be removed, and the opening 54 filled with an empty wire connector W so that the process may be continued.

When the wire connector W, having deposits as herein described, is engaged with a wire, the resin and hardener layers mix together, cure the resin to a solid state and produce a wire lock. The protective film over the deposits break up and "balls" up and assists in mixing the components.

In the foregoing, a mass production method has been described in which the uncured fluid resin and a mixture of fluid actuators or hardeners are deposited within a nested wire connector 136 in a layer-upon-layer relation, each deposit included an ultraviolet curable material which when subjected to ultraviolet light forms a protective film over deposits 26 and 30.

While this invention has been described as having a preferred design, it is understood that it is capable of further modifications, uses and/or adaptations thereof, and following a general principle of the invention and including such departures that come within known or customary practice in the art to which the invention pertains.

What we claim:

1. A wire connector, comprising:

(a) a basket having a chamber with an open end and an opposite closed end and an inner surface extending between said ends;

(b) a coil disposed within said chamber and extending from said closed end to a point intermediate said open end, said coil having first and second ends and an area between said first and second ends, said area being spaced a distance from said inner surface at least at several points;

(c) a mixable fastener composition filled within a portion of said chamber and encapsulating said coil, said composition being substantially devoid of air and substantially free of air pockets and having an overlying rupturable skin for maintaining said composition within said chamber; and (d) said portion of said chamber filled with said composition having substantially all of the atmosphere evacuated therefrom, prior to deposition of said composition.

2. The wire connector of claim 1, wherein:

(a) said composition includes one of an epoxy resin and a hardener.

3. The wire connector of claim 2, wherein:

(a) said composition includes a component curable with ultraviolet light for forming said skin.

4. The wire connector of claim 3, wherein:

(a) said composition further includes a photoinitiator for enhancing curing of the component upon exposure to ultraviolet light.

5. The wire connector of claim 4, wherein:

(a) said epoxy resin is a curable adhesive, and said hardener polymerizes said resin.

6. The wire connector of claim 1, further comprising:

(a) a second fastener composition positioned within said chamber and disposed intermediate said skin and said open end, said second composition reactive with said first mentioned composition for forming an adhesive bondable to an article inserted into said chamber and said second composition having an overlying rupturable skin for maintaining said second composition within said chamber.

7. The wire connector of claim 6, wherein:

(a) said first mentioned composition includes a photoreactive monomeric or oligomeric resin, and said second composition includes a dimethacrylate.

8. A wire nut assembly, comprising:

(a) an insulated basket having a chamber with an open end and an opposite closed end and an inner surface extending between said ends;

(b) a helical coil spring secured to said closed end and extending therefrom toward and terminating short of said open end, said spring having first and second ends and an intermediate area between said ends, said intermediate area being spaced a distance from said inner surface of said basket at least at several points;

(c) an epoxy resin material disposed within said chamber and filling a portion of said chamber by an amount sufficient to overlie said spring, said material having a rupturable skin for maintaining said material within said chamber;

(d) a hardener composition disposed within said chamber and overlying said skin, said composition having a rupturable skin for maintaining said composition within said chamber and said composition reactive with said material for forming an adhesive adapted for securing an article positioned within said chamber and engaged with said spring; and (e) said material being substantially devoid of air and air pockets and said portion of said chamber filled with said material having substantially all of the atmosphere evacuated therefrom, prior to deposition of said composition.

9. The assembly of claim 8, wherein:

(a) said chamber is generally frustoconical in vertical section, and said coil spring is secured to the frustum thereof.

10. The method of manufacturing a fastener assembly, comprising the steps of:

(a) providing a fastener housing having a chamber with an open end and a closed end;

(b) evacuating substantially all of the atmosphere from the chamber;

(c) filling at least a portion of the chamber with an adhesive system while the atmosphere is evacuated from the chamber; and (d) securing the system within the chamber.

11. The method of claim 10, including the step of:

(a) evacuating the atmosphere from the chamber with a vacuum.

12. A method of claim 10, including the step of:
(a) choosing the adhesive system from one of an epoxy resin system and a cooperating hardener.
13. A method of claim 10, including the step of:
(a) choosing an epoxy resin system as the adhesive system.
14. A method of claim 11, including the step of:
(a) securing the system within the chamber by forming a rupturable skin over the surface thereof.
15. A method of claim 14, including the step of:
(a) forming the rupturable skin from a portion of the adhesive system.
16. A method of claim 15, including the steps of:
(a) providing an adhesive system comprising a film forming compound curable with ultraviolet light; and
(b) exposing through the open end the adhesive system to ultraviolet light.
17. A method of claim 16, including the step of:
(a) filling a further portion of the chamber with a second adhesive system; and
(b) securing the second adhesive system within the chamber.
18. A method of claim 17, including the step of:
(a) choosing the first mentioned adhesive system from one of an epoxy resin and a cooperating hardener, and choosing the second adhesive system from the other one of an epoxy resin and the cooperating hardener.
19. A method of claim 18, including the steps of:
(a) providing the first mentioned and second adhesive systems with a film forming compound curable upon exposure to ultraviolet light; and
(b) exposing through the open end each of the first mentioned and second adhesive systems to ultraviolet light upon their being sequentially positioned within the chamber.
20. A wire connector manufacturing process, comprising the steps of:
(a) providing a wire connector basket having a chamber with an open end and a closed end, a coil spring being disposed within the chamber and extending from the closed end toward the open end and terminating short thereof;
(b) applying a vacuum to the chamber and evacuating substantially all of the atmosphere therefrom;
(c) supplying to the chamber while the atmosphere is evacuated therefrom a quantity of a first adhesive system sufficient to overlie the spring;
(d) securing the first adhesive system within the chamber;
(e) supplying to the chamber a quantity of a second adhesive system overlying the first system, the first and second systems being reactive for bonding an article inserted into the chamber; and
(f) securing the second adhesive system within the chamber.
21. The process of claim 20, and including the step of:
(a) securing each of the first and second adhesive systems within the chamber by a rupturable skin.
22. The process of claim 21, including the steps of:
(a) forming the rupturable skin by exposing the first and second adhesive systems to radiation.
23. The process of claim 22, including the step of:
(a) securing the first adhesive system within the chamber prior to supplying the second adhesive system thereto.
24. The process of claim 23, including the step of:
(a) exposing the first and second adhesive systems to ultraviolet light introduced through the open end.

* * * * *